US005218895A

United States Patent [19]

Lukich et al.

[11] Patent Number: 5,218,895

[45] Date of Patent: Jun. 15, 1993

[54] ELECTROHYDRAULIC CONTROL APPARATUS AND METHOD

[75] Inventors: Michael S. Lukich; Eric A. Hutchison, both of Peoria; Lisa A. Obermaier, Marquette Heights, all of Ill.

[73] Assignee: Caterpillar Inc., Peoria, Ill.

[21] Appl. No.: 540,726

[22] Filed: Jun. 15, 1990

[51] Int. Cl.[5] ..... F15B 13/16; F15B 13/044

[52] U.S. Cl. ..... 91/361; 91/459; 60/459

[58] Field of Search ..... 91/361, 459, 362, 466, 91/363 R, 363 A; 60/459

[56] References Cited

U.S. PATENT DOCUMENTS

| | | | |
|---|---|---|---|
| 3,038,451 | 6/1962 | Sporn et al. | 91/361 |
| 3,200,713 | 8/1965 | Viersma et al. | 91/49 |
| 3,410,177 | 11/1968 | Roess et al. | 91/361 |
| 3,667,225 | 6/1972 | Karman | 60/52 |
| 3,798,525 | 3/1974 | Cooper | 318/588 |
| 3,924,766 | 12/1975 | Canning | 214/764 |
| 4,586,332 | 5/1986 | Schexnayer | 60/468 |
| 4,595,979 | 6/1986 | Arai et al. | 91/361 X |
| 4,625,622 | 12/1986 | Gunda et al. | 91/36 |
| 4,737,705 | 4/1988 | Bitar et al. | 324/58.5 |
| 4,845,416 | 7/1989 | Scholl et al. | 318/600 |
| 4,852,657 | 8/1989 | Hardy et al. | 172/2 |

FOREIGN PATENT DOCUMENTS

| | | | |
|---|---|---|---|
| 567557 | 11/1958 | Belgium | 91/459 |
| 2251634 | 5/1974 | Fed. Rep. of Germany | 91/459 |
| 0143802 | 11/1981 | Japan | 91/361 |
| 1000612 | 3/1983 | U.S.S.R. | 91/361 |

OTHER PUBLICATIONS

European Patent Application, 0,104,613, published Mar. 4, 1984.

German Patent application, DT2,360,558A1, published Jul. 17, 1975.

German Patent Application, DE3,347,000A1, published Jul. 4, 1985.

German Patent Application, DE3,716,200A1, published Nov. 24, 1988.

U.S. patent application No. 07/501,381, filed Mar. 19, 1990 (FWC of Application No. 07/241,654, filed Sep. 8, 1988).

U.S. patent application No. 07/394,919, filed Aug. 17, 1989.

*Primary Examiner*—Edward K. Look
*Assistant Examiner*—Hoang Nguyen
*Attorney, Agent, or Firm*—James R. Yee

[57] ABSTRACT

An apparatus, is adapted to controllably position a movable element in a hydraulic motor. A controller receives a request signal and velocity and/or position signals from sensors. The controller, in accordance with a control scheme using velocity and/or position feedback, determines the flow of hydraulic fluid to the cylinder needed to reduce velocity and/or position errors. A directional valve, actuated by an electrohydraulic pilot system, delivers hydraulic fluid to the hydraulic motor.

19 Claims, 9 Drawing Sheets 202
220
216
E
R
208
214
206
T
P
218
212
200
215
204
210
CONTROLLER
222
226
PILOT SYSTEM
224

NONLINEARITY INVERTER
VELOCITY
POSITION
POSITION REQUEST SIGNAL
H (s) ff
H (s) fp2
H (s) fv
H (s) bv
H (s) bp
600
602
604
606
608
610
612
614
406
408
410
412
414
416
418
$p_r$
$p_e$
$v_{fd}$
$v_{sd}$
$v_a$
$p_a$
$f_c$

ELECTROHYDRAULIC CONTROL APPARATUS AND METHOD

DESCRIPTION

Technical Field

This invention relates generally to an apparatus and method for controlling the velocity and/or position of a hydraulic motor and more particularly, to an apparatus and method for controllably modulating piston velocity in a hydraulic cylinder using velocity feedback.

Background Art

Hydraulic systems are particularly useful in applications requiring a significant power transfer and are extremely reliable in harsh environments, for example, in construction and industrial work places. Earthmoving vehicles, such as excavators, backhoe loaders, and wheel type loaders are a few examples where the large power output and reliability of hydraulic systems are desirable.

Typically, a diesel or internal combustion engine drives the hydraulic system. The hydraulic system, in turn, delivers power to the vehicle's work implement. The hydraulic system typically includes a pump for supplying pressurized hydraulic fluid and a directional valve for controlling the flow of hydraulic fluid to a hydraulic motor which in turn delivers power to a work implement, i.e. a bucket.

For example, a typical excavator has three basic implement circuits, consisting of: boom, stick, and bucket appendages. Each appendage is controlled by individual directional valves and hydraulic cylinders. An operator controls the flow of hydraulic fluid, and therefore the velocity of each appendage, through one or more control handles which may be mechanical, electrical or electrohydraulic devices. The control handles provide means for manual operation; in which the displacement of the control handles is indicative of the desired flow of hydraulic fluid.

Fluctuations in pressure and flow of the hydraulic fluid supplied by the pump are inherent characteristics of hydraulic systems. These fluctuations present several problems which the control system must accommodate.

Supply pressure fluctuations have several causes. First, hydraulic circuits are often connected in series and are driven by the same pump. Each hydraulic circuit, through its individual operations, affects the hydraulic supply pressure. Second, since the pump is driven by the engine, the engine RPM also affects supply pressure.

Also, a varying load on the work implement affects the amount of flow request needed to produce the desired cylinder velocity (the work implement may be empty or may be filled and the load may vary while the implement is moving).

In order to have consistent system response, it is necessary to have a fixed flow of hydraulic fluid to the cylinder for a fixed flow request. Supply pressure variations and varying loads affect the flow rate and therefore, cause the control system to produce undesirable behavior.

U.S. Pat. No. 4,586,332, issued to Schexnayder, on May 6, 1986, discloses a two spool valve design for providing pressure compensation. As shown in FIG. 1, a directional control spool 104 has extend, retract and neutral positions for controlling the flow of hydraulic fluid to a hydraulic motor 102 A flow control spool 106 maintains a predetermined pressure differential across the directional control spool 104. Excess fluid from the pump is bypassed by the flow control spool to tank. This two spool valve design attempts to give a fixed flow rate for the extend and retract positions of the direction control spool 106 regardless of the load. However, the valve design is complex and adds cost to the system. Further, the two spool valve design does not accommodate over-running cylinder loads.

Some control systems may be responsive to position requests instead of flow requests. That is, rather than receiving signals indicative of a desired flow of hydraulic fluid (from control handles or other sources), the control system receives signals indicative of a desired cylinder position or displacement.

Industrial robots are typical applications where the large power output and reliability of hydraulic systems prove beneficial and require a control system to respond to position signals. However, the tasks industrial robots are designed to perform require a control system with fast response times and high accuracy. Present hydraulic control systems are unable to provide acceptable response time and the accuracy necessary for this type of application. For these reasons, industrial robots are usually powered by expensive electric motors.

The present invention is directed at overcoming one or more of the problems as set forth above.

DISCLOSURE OF THE INVENTION

In one aspect of the present invention, an apparatus for controllably moving a movable element within a hydraulic motor in response to a flow request signal is provided. Hydraulic fluid is delivered to the hydraulic motor in response to pilot pressure signals. The actual velocity of the hydraulic motor is sensed and a desired velocity signal is produced based on the flow request signal. A velocity error signal is produced based on the desired velocity signal and the actual velocity. A flow command signal is produced based on the desired velocity signal and the velocity error signal. A pilot pressure signal, indicative of the desired flow of hydraulic fluid, is produced based on the flow command signal.

In another aspect of the invention, a method for controllably moving a movable element within a hydraulic motor in response to a flow request signal is provided. The method includes the following steps: the actual velocity of the movable element is sensed and an actual velocity signal is produced. The velocity signal is processed and a flow command signal indicative of the desired flow of hydraulic fluid is produced.

BEST MODE FOR CARRYING OUT THE INVENTION

Figure 1:
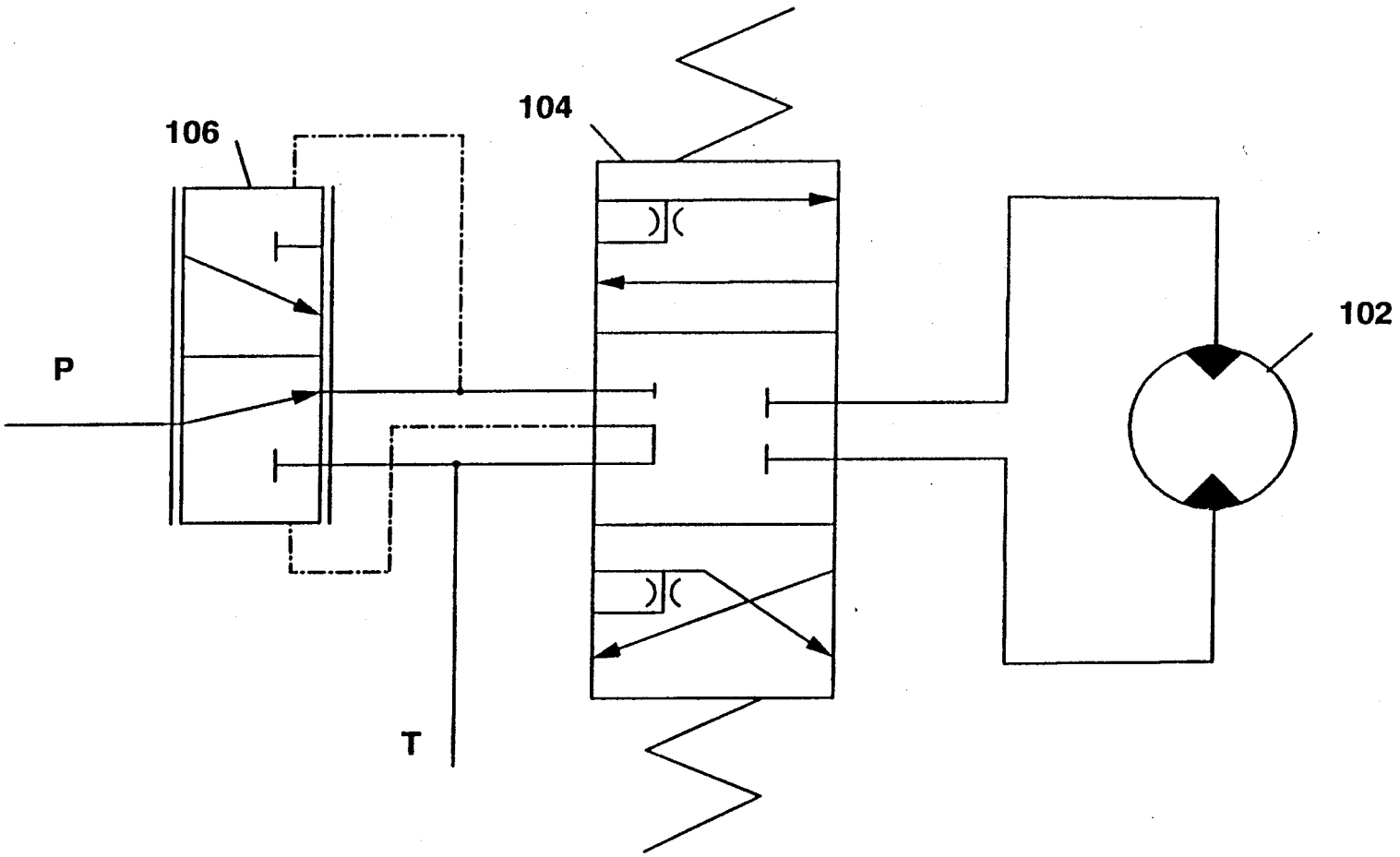
PRIOR ART FIG. 1
FIG. 1 is a block diagram of a two spool valve system as known in the prior art.
Figure 2:
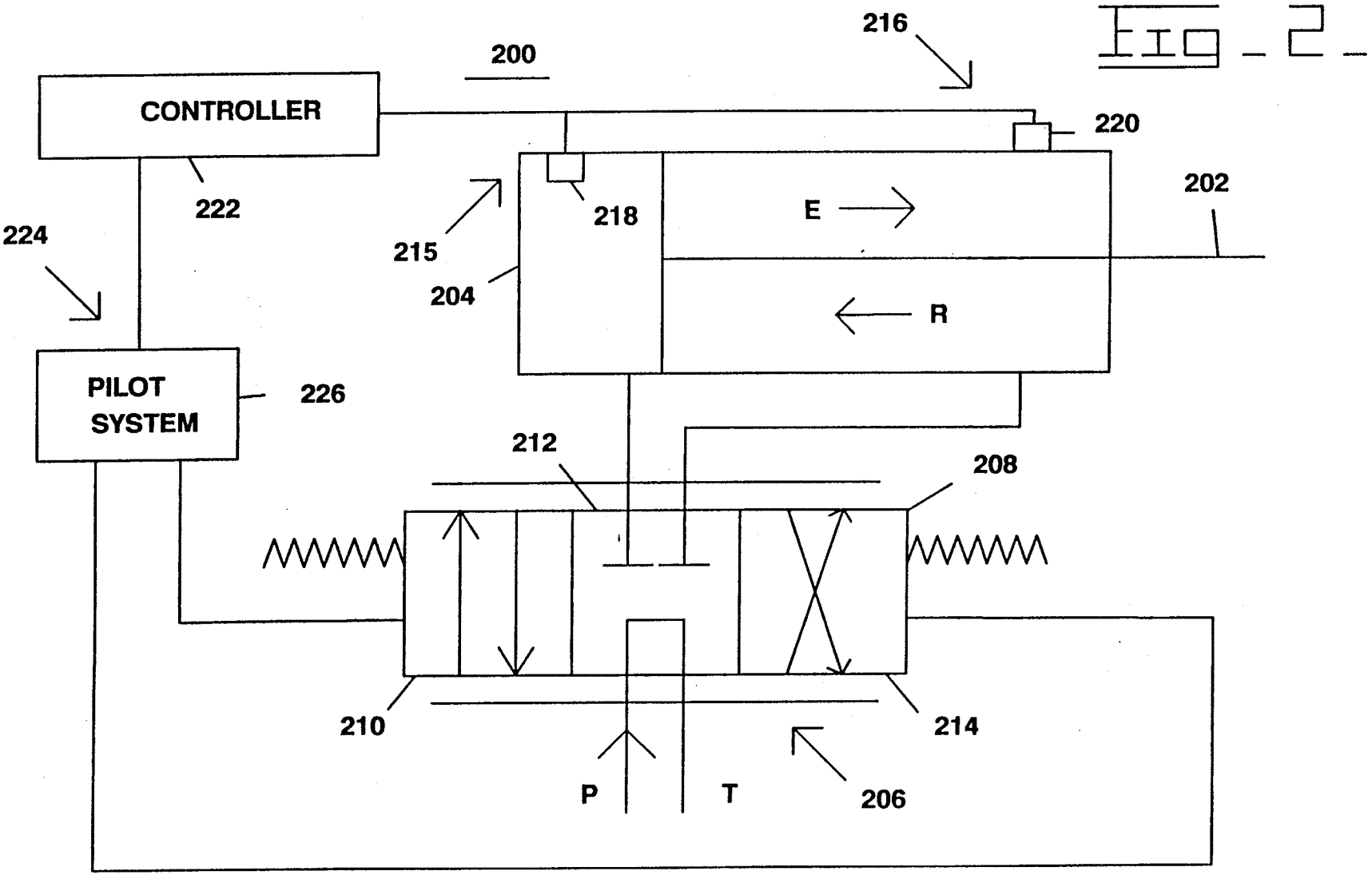
FIG. 2 is a block diagram of a control system having an electrohydraulic pilot system and a spool valve connected between a controller and a hydraulic cylinder.

With reference to FIG. 2, the present invention 200 is adapted to controllably position a movable element 202 in a hydraulic motor 204. In the preferred embodiment, the hydraulic motor 204 is a hydraulic cylinder and the movable element 202 is a piston within the cylinder, as shown.

A means 206 delivers hydraulic fluid to the hydraulic cylinder 204. In the preferred embodiment, the hydraulic fluid delivering means 206 includes an open center directional valve 208 (spool valve). The directional valve 208 has three flow positions 210,212,214 for controlling the flow of hydraulic fluid to the hydraulic cylinder 204.

Figure 3A:
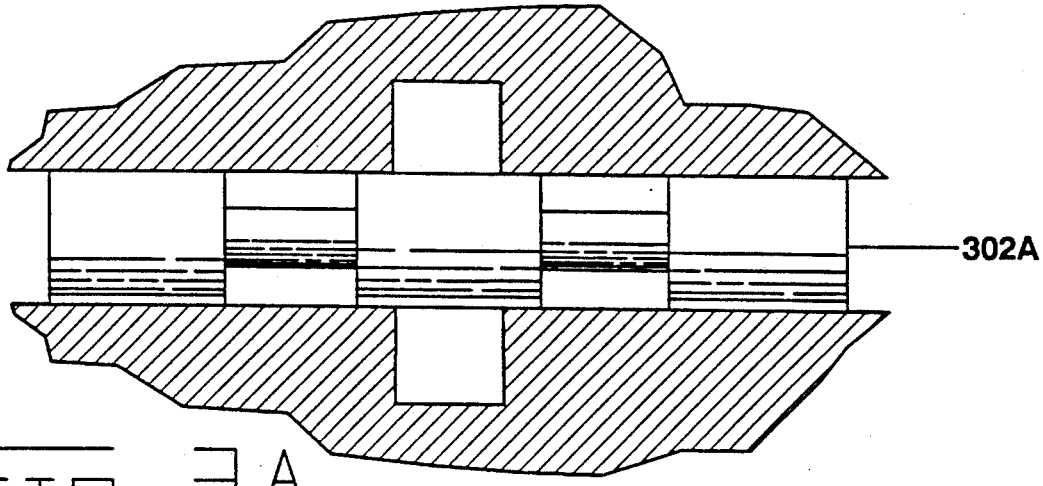
FIG. 3A is a diagrammatic view of a directional valve having an overlapped spool.
Figure 3B:
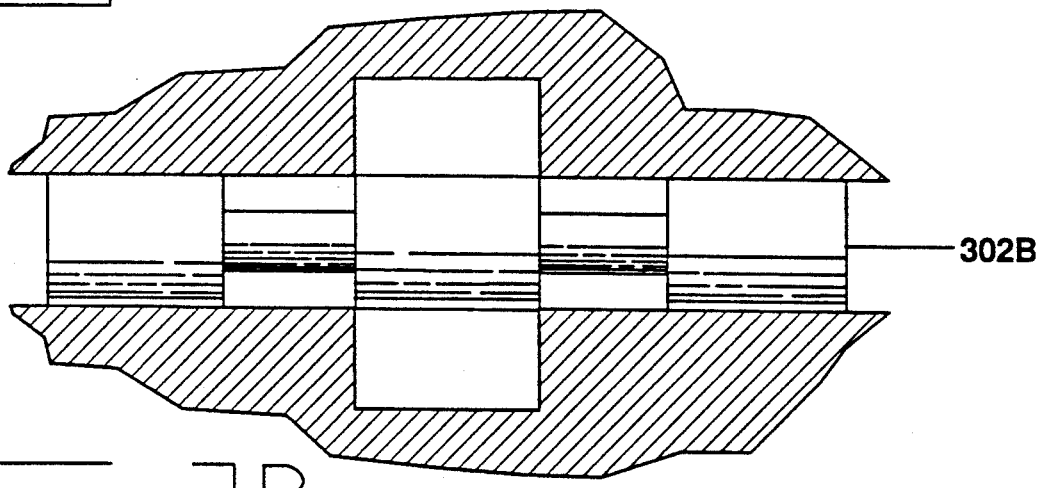
FIG. 3B is a diagrammatic view of a directional valve having a critically-lapped spool.
Figure 3C:
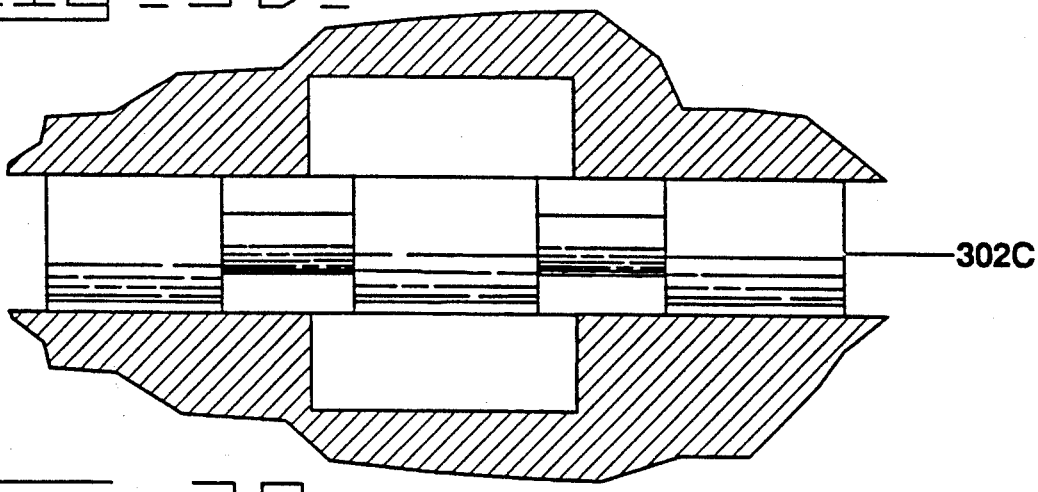
FIG. 3C is a diagrammatic view of a directional valve having an underlapped spool.

As shown in FIG. 3A, in a first embodiment, the directional valve 208 has an overlapped spool 302A. In a second embodiment, as shown in FIG. 3B, the directional valve 208 includes a critically-lapped spool 302B. And in a third embodiment, the directional valve 208 includes an underlapped spool 302C, as shown in FIG. 3C. Any one of the three spools 302A,302B,302C may be used. Their advantages/disadvantages are well known in the art and the choice of spool 302A,302B,302C is dependent upon the type of application.

Returning to FIG. 2, in the first flow position 210, hydraulic fluid under pressure (generally denoted as P and typically below 10,000 psi) from a pump (not shown) passes through the directional valve 208 to the back end of the hydraulic cylinder 204. The hydraulic fluid from the pump acts to extend the piston 202 by exerting a force on the back end of the piston 202 in the direction of the arrow labeled E. Hydraulic fluid from the front end of the hydraulic cylinder 204 passes through the directional valve 208 and back to a tank of hydraulic fluid, T.

In the second or neutral flow position 212, the piston 202 is held at its current position. Since the hydraulic fluid and the pump are doing a minimal amount of work, the pump is destroked, thereby reducing flow to minimize losses (note that the pump may remain stroked to power other hydraulic circuits.)

When the directional valve 208 is in the third flow position 214, hydraulic fluid passes through the directional valve 208 to the front end of the hydraulic cylinder 204 and exerts a force on the front end of the piston 202 in the direction of the arrow labeled R. Hydraulic fluid from the back end of the hydraulic cylinder 204 also passes through the directional valve 208 to the tank, T.

A means 215 senses the actual position of the piston 202 and produces a signal, $p_a(t)$, indicative of the relative measured extension or retraction of the piston 202. In one embodiment, the means 215 includes a radio frequency (RF) linear position sensor 218, as disclosed in U.S. Pat. No. 4,737,705, issued Apr. 12, 1988 to Bitar, et al. In another embodiment, the means 215 includes a potentiometer based sensor (not shown). And in a third embodiment, the means 215 includes a resolver (not shown). Use of both the resolver and the potentiometer based sensors are well known in the art and are therefore not further discussed.

A means 216 senses the actual velocity of the piston 202 and produces a signal, $v_a(t)$, indicative of the measured velocity of the piston 202. In one embodiment, the means 216 includes a velocity sensor 220. The velocity sensor 220 includes a DC generator which when rotated, generates a voltage indicative of the velocity of rotation (and therefore the linear velocity of the piston 202). In a second embodiment, the means 216 receives the position signal, $p_a(t)$, and determines the velocity of the piston 202 by numerically filtering and differentiating the position signal, $p_a(t)$.

A controller 222 processes the acquired velocity and position signals, $v_a$,$p_a(t)$, produces a compensated velocity signal, $v_c(t)$, and a flow command signal, $f_c(t)$. The flow command signal, $f_c(t)$, is indicative of the desired flow of hydraulic fluid to the hydraulic cylinder 204 and is preferably proportional to the compensated velocity signal, $v_c(t)$.

A means 224 receives the flow command signal, $f_c(t)$, and produces a pilot pressure signal, $p_p(t)$. In one embodiment, the means 224 includes an electrohydraulic pilot system 226. The pilot system 226 includes a proportional pilot pressure solenoid valve. The flow command signal, $f_c(t)$, actuates the solenoid valve, which in turn, delivers pilot pressure signals, $p_p(t)$, to the directional valve 208. The pilot pressure signals, $p_p(t)$, are in the form of hydraulic fluid under low pressure (typically, below 1000 psi). The hydraulic fluid acts on the spool 302 to place the directional valve 208 into one of the flow positions 210,212,214. The pilot system 226 is well known in the art and is therefore not further discussed.

In the preferred embodiment, the controller 222 includes a microprocessor. The microprocessor receives the position signal, $p_a(t)$, from the position sensor 218. In one embodiment, the microprocessor also receives the velocity signal, $v_a(t)$, from the velocity sensor 220. In a second embodiment, the microprocessor computes the velocity of the piston 202 by numerically filtering and differentiating the position signal, $p_a(t)$.

Figure 4:
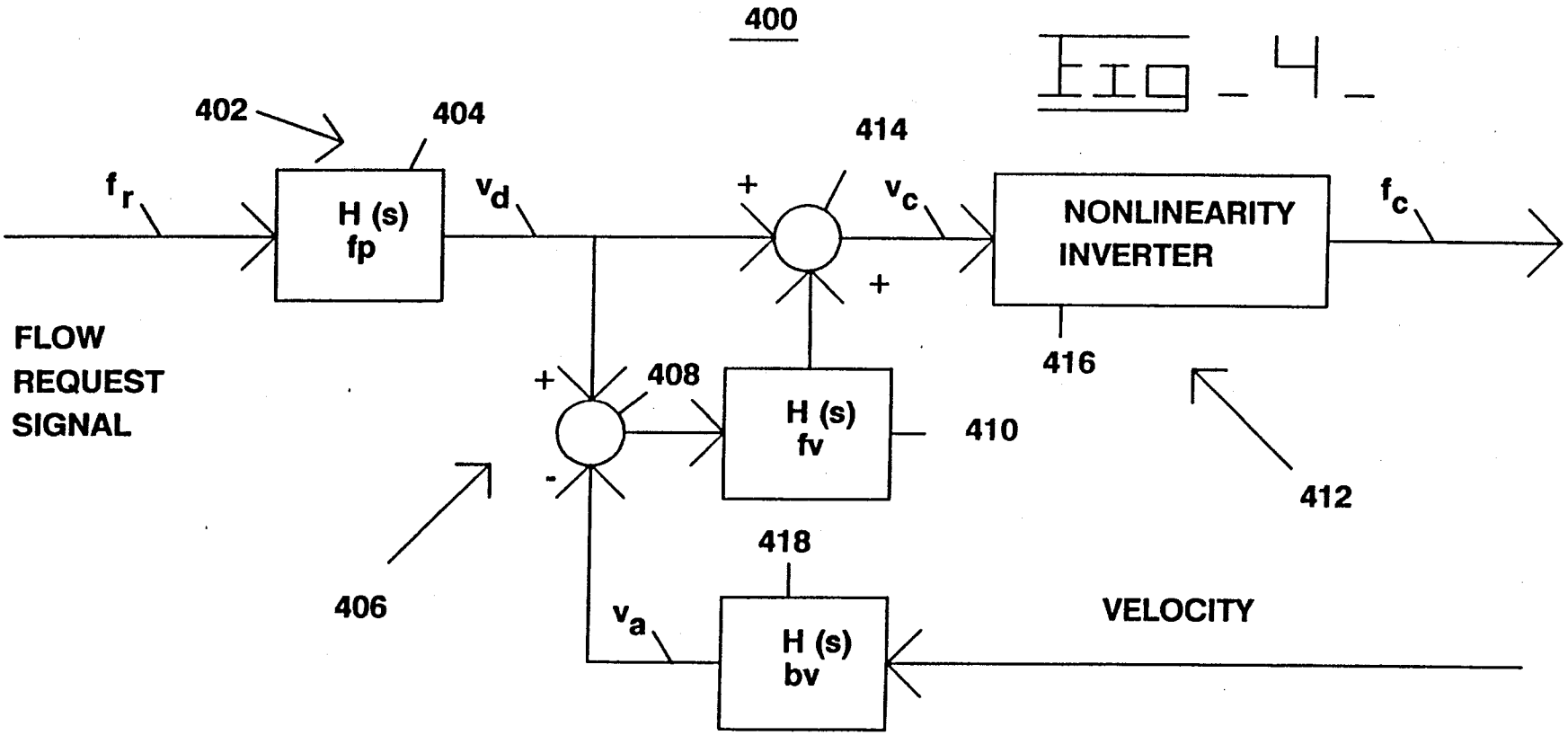
FIG. 4 is a block diagram of a control scheme using velocity feedback according to the present invention.
Figure 5A:
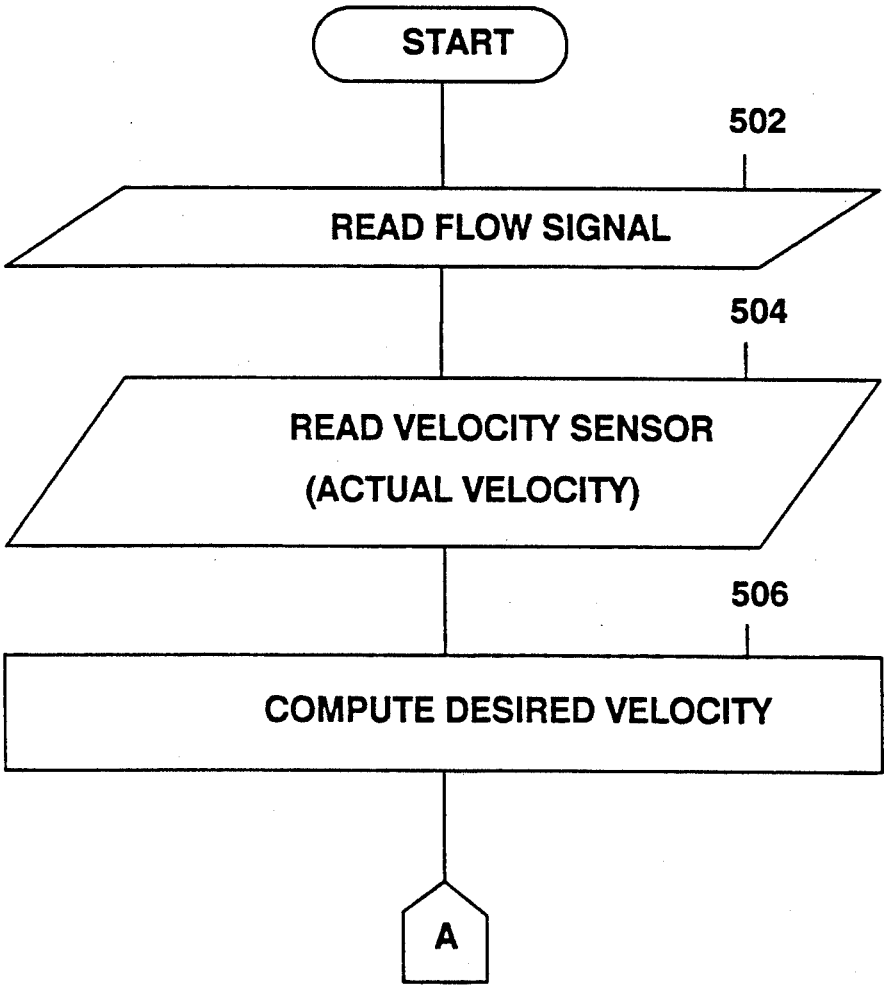
FIG. 5A is a flow diagram of a first portion of the control scheme of FIG. 4.
Figure 5B:
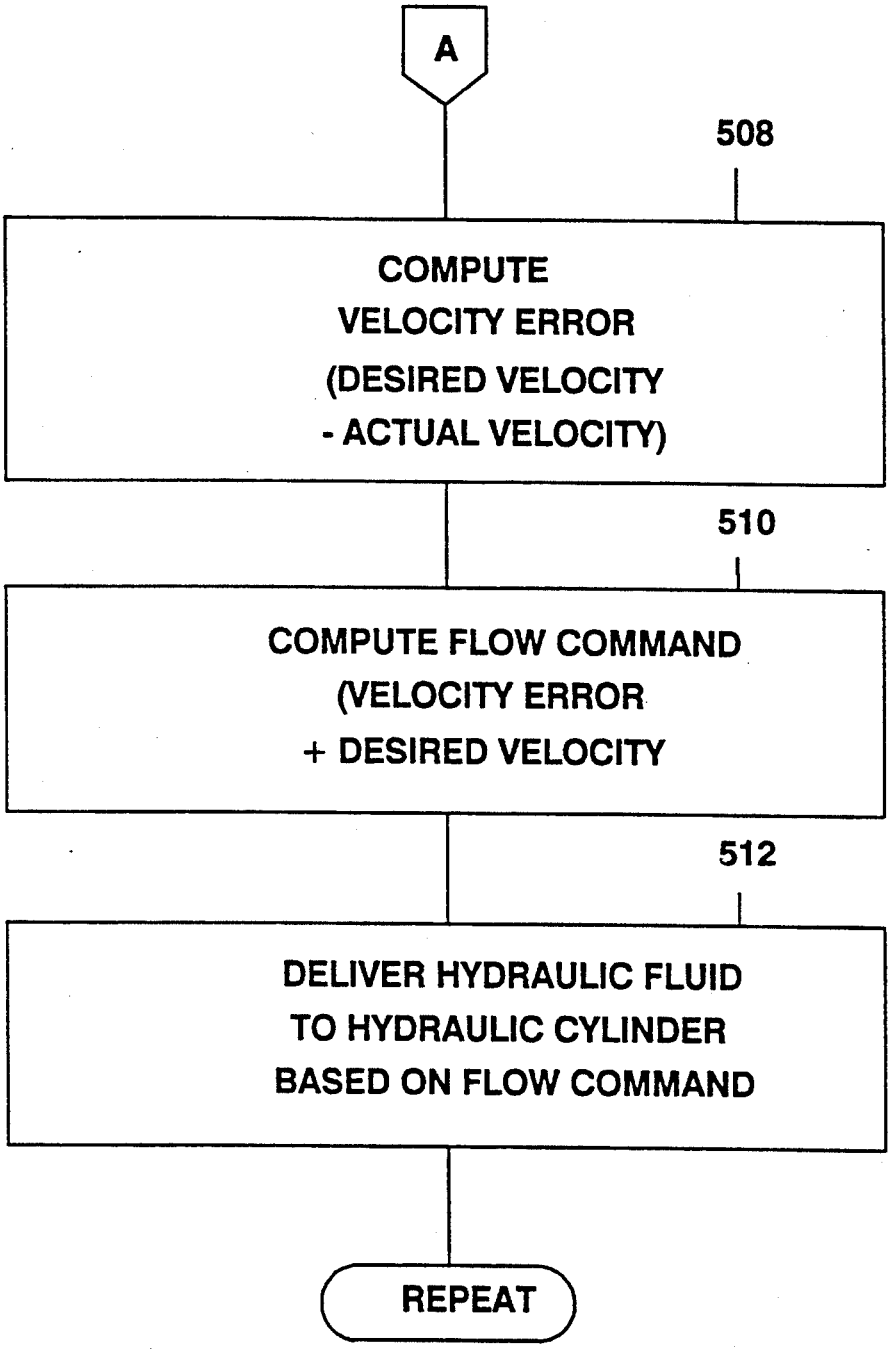
FIG. 5B is a flow diagram of a second portion of the control scheme of FIG. 4.

The controller 222 receives a request signal, signals from one or more sensors 218,220 and produces the flow command signal, $f_c(t)$. In a first embodiment, the controller 222 receives the actual velocity signal, $v_a(t)$, and produces the flow command signal, $f_c(t)$, in accordance with a first control scheme 400, as shown in FIGS. 4, 5A, and 5B. In the first embodiment, the controller 222 receives a flow request signal, $f_r(t)$, which is indicative of the desired velocity of the piston 202, and is typically proportional to the displacement of an operator actuated control handle. Operator actuated control handles are well known in the art and are therefore not further discussed. The velocity signal, $v_a(t)$, represents the actual velocity of the piston 202.

A means 402 receives the flow request signal, $f_r(t)$ and produces a desired velocity signal, $v_d(t)$. In the preferred embodiment, the means 402 implements a first transfer function, $h_{fp}(t)$ 404. The first transfer function, $h_{fp}(t)$ 404 scales the flow request signal, $f_r(t)$ to pro the desired velocity signal, $v_d(t)$.

The La Place transform of the first transfer function, $h_{fp}(t)$ 404 is denoted as $H_{fp}(s)$ and is of the form:

$H_{fp}(s)=K_1$.

Therefore, $V_d(s)=K_1\times F_r(s)$, where $K_1$ is a constant, $V_d(s)$ is the La Place transform of the desired velocity signal and $F_r(s)$ is the La Place transform of the flow request signal.

A means 406 subtracts the actual velocity signal, $v_a(t)$, from the desired velocity signal, $v_d(t)$, and produces a velocity error signal, $v_e(t)$ In the preferred embodiment, the means 406 includes a first summing junction 408 and implements a second transfer function, $h_{fv}(t)$ 410. The second transfer function, $h_{fv}(t)$ 410 provides velocity feedback compensation and, in the preferred embodiment, scales and integrates the output of the first summing junction 408 to produce the velocity error signal, $v_e(t)$.

The La Place transform of the second transform function, $h_{fv}(t)$ is denoted as $H_{fv}(s)$ and is of the form:

$H_{fv}(s)=K_2/s$, where $K_2$ is a constant.

Therefore, $$\begin{aligned} V_e(s) &= H_{fv}(s) + (V_d(s) - V_a(s)) \\ &= K_2 \times (V_d(s) - V_a(s))/s. \end{aligned}$$

where $V_e(s)$ and $V_a(s)$ represent La Place transforms of the velocity error signal and the actual velocity signal, respectively.

A means 412 receives the desired velocity signal, $v_d(t)$, and the velocity error signal, $v_e(t)$, and produces the flow command signal, $f_c(t)$. In the preferred embodiment, the flow command signal, $f_c(t)$, is a pulse width modulated (PWM) drive current applied to the solenoid of the pilot system 226. The flow command signal, $f_c(t)$, actuates the solenoid. The means 412 includes a second summing junction 414 and a nonlinearity inverter 416. The second summing junction 414 adds the desired velocity signal, $v_d(t)$ and the velocity error signal, $v_e(t)$ to produce the compensated velocity signal, $v_c(t)$. The nonlinearity inverter 416 receives the compensated velocity signal, $v_c(t)$, and produces the flow command signal, $f_c(t)$.

The nonlinearity inverter 416 compensates for the nonlinearities of the directional valve 208 and in the preferred embodiment includes a map in the controller 222. The steady-state characteristics, particularly, the deadband and flow gain characteristics, are measured and are stored in the map. The nonlinearity inverter 416 receives the compensated velocity signal and uses the map to determine the appropriate flow command signal, $f_c(t)$.

The velocity sensing means 216 includes a third transfer function, $H_{bv}(s)$ 418. The third transfer function $H_{bv}(s)$ 418, mitigates sensor noise by filtering the output of the velocity sensor 220 to produce the actual velocity signal, $v_a(t)$. In the preferred embodiment, the third transfer function 418 is a second order filter with a corner frequency around 10 Hz.

The La Place transform of the third transfer function is denoted as $H_{bv}(s)$ and is of the form:

$$K_3\{s^2+(K_4\times s)+K_3\},$$

where $K_3$ and $K_4$ are constants.

Referring to FIGS. 5A and 5B, the controller 222 delivers a controlled flow of hydraulic fluid to the hydraulic cylinder 204 using the following procedure: First, as shown in block 502, the flow request signal, $f_r(t)$ is retrieved. In the preferred embodiment, the flow request signal is stored in a memory location within the controller 222. The microprocessor reads the memory location to determine the desired flow. Then, the actual velocity of the piston 202 is determined by reading the velocity sensor 220 (block 504). In block 506, the desired velocity signal is computed by scaling the flow request signal.

In block 508 (FIG. 5B), the actual velocity signal is subtracted from the desired velocity signal. The result is scaled to produce a velocity error signal. The velocity error signal is then added to the desired velocity signal (block 510). The velocity error signal is used to calculate the flow of hydraulic fluid needed to correct the velocity error (block 512). The calculated flow of hydraulic fluid is then delivered to the hydraulic cylinder 204 via the pilot system 226, as described above. This process is then repeated.

Figure 6:
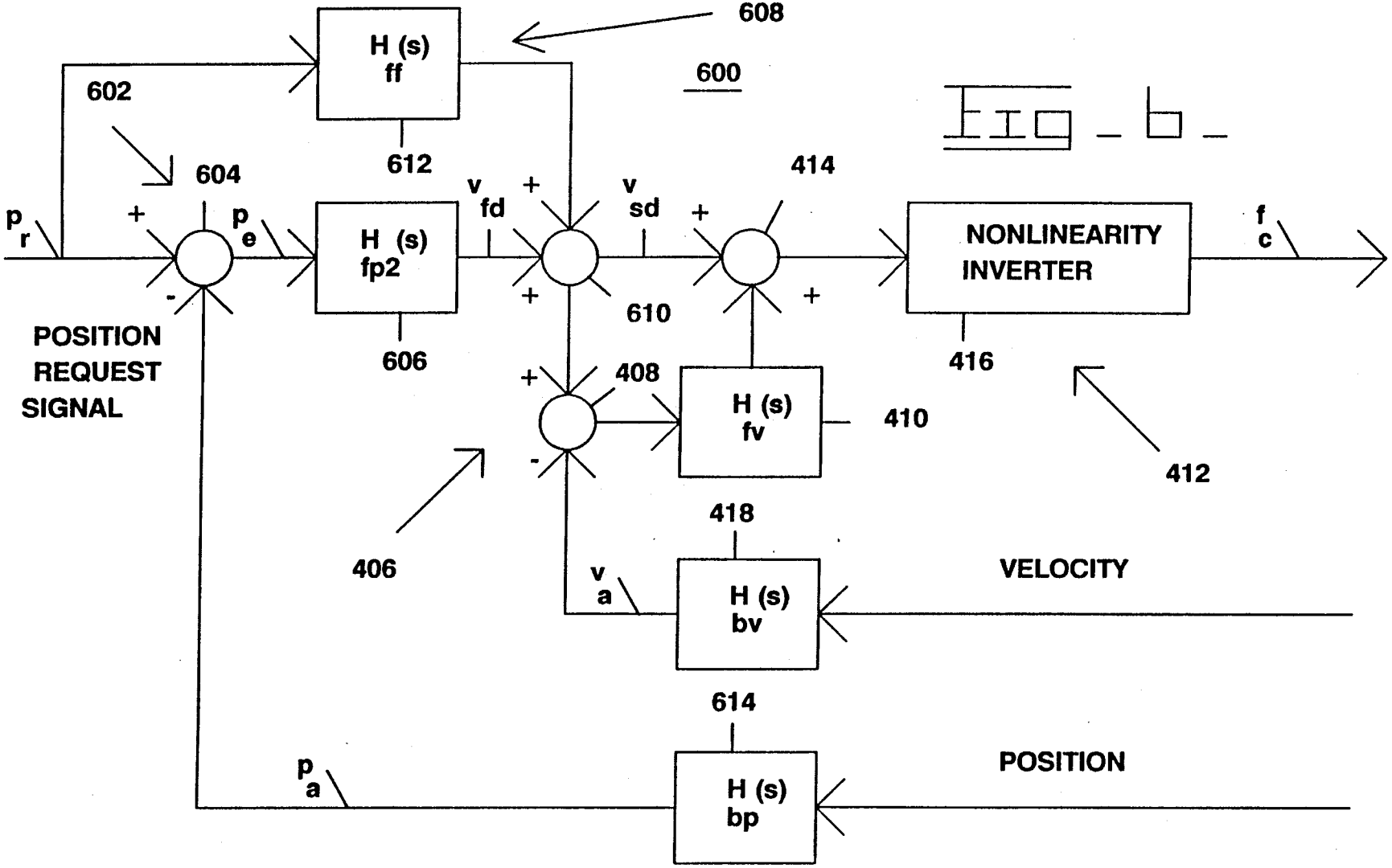
FIG. 6 is a block diagram of a control scheme using position and velocity feedback according to the present invention.
Figure 7A:
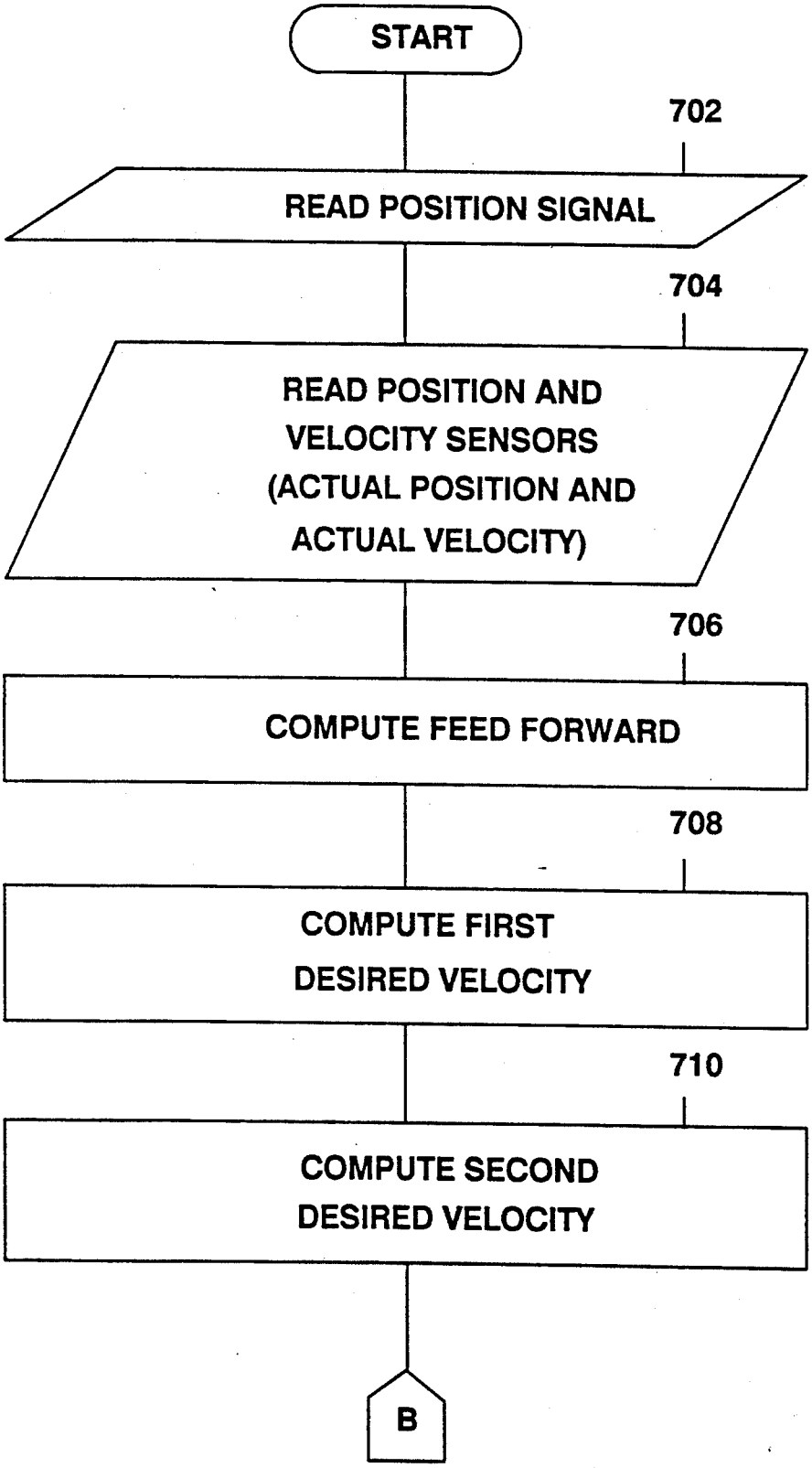
FIG. 7A is a flow diagram of a first portion of the control scheme of FIG. 6.
Figure 7B:
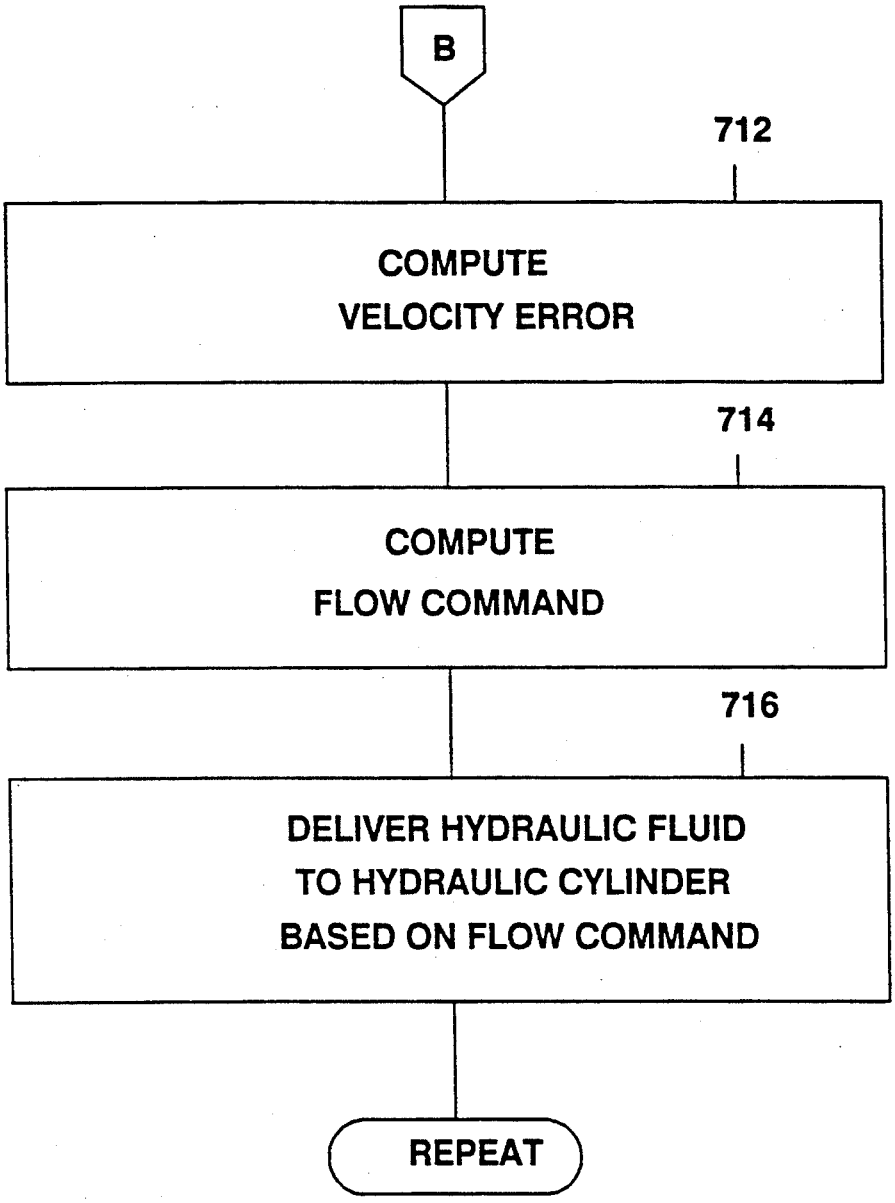
FIG. 7B is a flow diagram of a second portion of the control scheme of FIG. 6.

In a second embodiment, the controller 222 receives the actual velocity signal, $v_a(t)$, and the actual position signal, $p_a(t)$, and produces the flow command signal, $f_c(t)$, in accordance with a second control scheme 600, as shown in FIGS. 6, 7A, and 7B. In the second embodiment, the controller 222 is responsive to a position request signal, $p_r(t)$, which is indicative of a desired position of the piston 202.

A means 602 receives the position request signal, $p_r(t)$ and the actual position signal, $p_a(t)$, produces a first desired velocity signal, $v_{fd}(t)$. The first desired velocity signal producing means 602 includes a third summing junction 604 and implements a fourth transfer function $H_{fp2}(t)$. The third summing junction 604 subtracts the actual position signal, $p_a(t)$ from the position request signal, $p_r(t)$, and produces a position error signal, $p_e(t)$. The fourth transfer function, $h_{fp2}(t)$ 606 scales the position error signal, $p_e(t)$ to produce the first desired velocity signal, $v_{fd}(t)$. In an alternate embodiment, the fourth transfer function 606 also filters the position error signal, $p_e(t)$.

The La Place transform of the fourth transfer function, $h_{fp2}(t)$ 606 is denoted as $H_{fp2}(s)$ and is of the form:

$H_{fp2}(s)=K_5$.

Therefore, $V_{fd}(s)=K_5\times P_e(s)$, where $K_5$ is a constant, $V_{fd}(s)$ is the La Place transform of the first desired velocity signal and $P_e(s)$ is the La Place transform of the position error signal.

A means 608 provides feed forward compensation. The feed forward compensation providing means 608 includes a fourth summing junction 610 and implements a fifth transfer function $H_{ff}(s)$ 612. The fifth transfer function, $H_{ff}(s)$ 612, scales and differentiates the position request signal, $p_r(t)$. The fourth transfer function 606, $H_{fp2}(s)$ may have some inherent phase lag, particularly at low frequencies. The fifth transfer function 612 provides phase lead to improve system response and to compensate for the phase lag of the fourth transfer function 612.

The fourth summing junction 610 adds the output of the fifth transfer function 612 to the first desired velocity signal, $v_{fd}(t)$, to produce a second desired velocity signal, $v_{sd}(t)$.

The La Place transform of the fifth transfer function, $h_{ff}(t)$ 612 is denoted as $H_{ff}(s)$ and is of the form:

$$H_{ff}(s)=s\times K_6,$$

where $K_6$ is a constant.
Therefore, $$\begin{aligned} V_{sd}(s) &= h_{ff}(s)\times P_r(s)+V_{fd}(s) \\ &= s\times P_r(s)\times K_6+V_{fd}(s), \end{aligned}$$

where $V_{sd}(s)$ represents the La Place transfer function of the second desired velocity signal.

The position sensing means 215 includes a sixth transfer function 614, $H_{bp}(s)$. The sixth transfer function 614, $H_{bp}(s)$, mitigates sensor noise by filtering the output o the position sensor 218 to produce the actual position signal, $p_a(t)$. In the preferred embodiment, the sixth transfer function 614 is a second order polynomial with a corner frequency around 10 Hz (similar to the third transfer function 424).

The second desired velocity signal, $v_{sd}(t)$ is processed, similarly to the desired velocity signal, $v_d(t)$ in the first control scheme 400, to produce the flow command signal, $f_c(t)$.

Referring to FIGS. 7A and 7B, the controller 222 precisely controls flow of hydraulic fluid to the hydraulic cylinder 204 according to the following procedure: First, as shown in block 702, the position request signal, $p_r(t)$ is retrieved. In the preferred embodiment, the position request signal is stored in a memory location within the controller 222. The microprocessor reads the memory location to determine the desired position. Then, the actual position and velocity of the piston 202 is determined by reading the position and velocity sensors 218,220 (block 704 . In block 706, the feed forward compensation is calculated by scaling and taking the derivative of the position request signal. As shown in block 708, the first desired velocity signal is computed by scaling the position request signal. In block 710 the second desired velocity signal is generated by adding the feed forward compensation and the first desired velocity signal.

In block 712 (FIG. 7B), the actual velocity signal is subtracted from the second desired velocity signal. The result is scaled to produce a velocity error signal. The velocity error signal is then added to the second desired velocity signal (block 714). The velocity error signal is used to calculate the flow of hydraulic fluid needed to correct the position and velocity errors (block 716). The calculated flow of hydraulic fluid is then delivered to the hydraulic cylinder 204 via the pump and pilot system 226, as described above. This process is then repeated.

INDUSTRIAL APPLICABILITY

With reference to the drawings, and in operation, the present invention is adapted to control the linear extension of a hydraulic cylinder. In the excavator discussed above, each appendage is controlled by at least one hydraulic cylinder. Each hydraulic cylinder 204 has an associated hydraulic fluid delivering means 206, an actual position sensing means 215, and an actual velocity sensing means 216. The controller 222 receives appropriate signals ($v_a(t)$) from each velocity sensing means 216 and delivers appropriate signals ($f_c(t)$) to each hydraulic fluid delivering means 206. The first control scheme 400 is duplicated and adapted for each linkage.

A flow request signal ($f_r(t)$) for each hydraulic cylinder is received by the controller 222. The flow request signals may be delivered by a manual, semiautomatic, or automatic control system. The source of these signals, however, is not relevant to the present invention.

With reference to one hydraulic cylinder, desired velocity signals and velocity error signals ($v_{fd}(t)$,$v_{sd}(t)$,$v_e(t)$) and a compensated velocity signal will be produced.

The nonlinearity inverter 416 receives the compensated velocity signal and delivers a flow command signal, $f_c(t)$, to the pilot system 226. The pilot system 226 delivers pilot pressure signals to the directional valve 208 and the directional valve 208 provides flow of hydraulic fluid to the hydraulic cylinder 204 to minimize the velocity error, $v_e(t)$.

We claim:

1. An apparatus for controllably moving a movable element within a hydraulic motor in response to a flow request signal, comprising:

means for delivering hydraulic fluid to said hydraulic motor in response to pilot pressure signals;

means for sensing the velocity of the movable element and producing an actual velocity signal indicative of said sensed velocity;

means for receiving said flow request signal and responsively producing a desired velocity signal;

means for receiving said actual velocity signal and said desired velocity signal and responsively producing a velocity error signal;

means for receiving said desired velocity signal and said velocity error signal, and responsively producing a flow command signal as a function of said desired velocity signal and said velocity error signal; and, means for receiving said flow command signal and responsively producing a pilot pressure signal and delivering said pilot pressure signal to said hydraulic fluid delivering means.

2. An apparatus, as set forth in claim 3, wherein said hydraulic motor is a hydraulic cylinder and said movable element is a piston.

3. An apparatus, as set forth in claim 1, wherein said pilot pressure signal is proportional to said flow command signal.

4. An apparatus, as set forth in claim 1, wherein said hydraulic fluid delivering means includes a directional valve.

5. An apparatus, as set forth in claim 4, wherein said directional valve has an extend, a neutral and a retract flow position.

6. An apparatus, as set forth in claim 1, wherein said velocity error signal producing means includes means for determining the difference between said actual velocity signal and said desired velocity signal and wherein said velocity error signal is a function of said difference.

7. An apparatus for controllably positioning a movable element in a hydraulic motor in response to an position request signal, comprising:

means for delivering hydraulic fluid to said hydraulic motor in response to pilot pressure signals;

means for sensing the velocity of the movable element and producing an actual velocity signal indicative of said sensed position;

means for sensing the velocity of the movable element and producing an actual velocity signal indicative of said sensed velocity;

means for receiving said position request signal and said actual position signal and responsively producing a desired velocity signal;

means for receiving said actual velocity signal and said desired velocity signals and responsively producing a velocity error signal;

means for receiving said desired velocity signal and said velocity error signal, and responsively producing a flow command signal as a function of said desired velocity signal and said velocity error signal; and, means for receiving said flow command signal and responsively producing a pilot pressure signal and delivering said pilot pressure signal to said hydraulic fluid delivering means.

8. An apparatus, as set forth in claim 7, wherein said hydraulic motor is a hydraulic cylinder and said movable element is a piston.

9. An apparatus, as set forth in claim 7, including means for providing feed forward compensation.

10. An apparatus, as set forth in claim 7, wherein said velocity sensing means includes means for receiving said position signal and for determining said actual velocity signal by filtering and differentiating said position signal.

11. An apparatus, as set forth in claim 7, wherein said pilot pressure signal is proportional to said flow command signal.

12. An apparatus, as set forth in claim 7, wherein said hydraulic fluid delivering means includes a directional valve.

13. An apparatus, as set forth in claim 12, wherein said directional valve has an overlapped spool.

14. An apparatus, as set forth in claim 12, wherein said directional valve has a critically-lapped spool.

15. An apparatus, as set forth in claim 12, wherein said directional valve has an underlapped spool.

16. An apparatus, as set forth in claim 12, wherein said directional valve has an extend, a neutral and a retract flow position.

17. A method for controllably moving a movable element within a hydraulic motor in response to a flow request signal, comprising the steps of:

sensing the actual velocity of said movable element and responsively producing an actual velocity signal;

receiving said flow request signal command and said actual velocity signal and responsively producing a desired velocity signal;

receiving said desired velocity signal and said actual velocity signal and responsively producing a velocity error signal;

receiving said velocity error signal and said desired velocity signal and responsively producing a flow command signal as a function of said desired velocity signal and said velocity error signal; and receiving said flow command signal and producing a flow of hydraulic fluid to said hydraulic motor in response to said flow command signal.

18. A method, as set forth in claim 17, wherein said velocity error signal producing step includes the step of determining the difference between said actual velocity signal and said desired velocity signal.

19. A method for controllably positioning a movable element in a hydraulic motor in response to an position request signal, comprising the steps of:

sensing the actual position of said movable element and responsively producing an actual position signal;

sensing the actual velocity of said movable element and responsively producing an actual velocity signal;

receiving said position request signal and said actual position signal and responsively producing a desired velocity signal;

receiving said desired velocity signal and said actual velocity signal and responsively producing a velocity error signal;

receiving said velocity error signal and said desired velocity signal and responsively producing a flow command signal as a function of said desired velocity signal and said velocity error signal; and receiving said flow command signal and producing a flow of hydraulic fluid to said hydraulic motor in response to said flow command signal.

* * * * *

UNITED STATES PATENT AND TRADEMARK OFFICE

CERTIFICATE OF CORRECTION

PATENT NO. : 5,218,895

DATED : June 15, 1993

INVENTOR(S) : Michael S. Lukich, Eric A. Hutchison and Lisa A. Obermaier

It is certified that error appears in the above-identified patent and that said Letters Patent is hereby corrected as shown below:

Column 8, line 66, "velocity" should be --position--.

Column 8, line 67, "velocity" should be --position--.

Signed and Sealed this

Twenty-fifth Day of January, 1994

*Attest:*

Bruce Lehman

BRUCE LEHMAN

*Attesting Officer*

*Commissioner of Patents and Trademarks*